US010077568B2

(12) United States Patent
Huber

(10) Patent No.: US 10,077,568 B2
(45) Date of Patent: Sep. 18, 2018

(54) COMBINATION FOLDING SPA COVER AND RECEPTACLE

(71) Applicant: Abram Huber, Lake City, FL (US)

(72) Inventor: Abram Huber, Lake City, FL (US)

( * ) Notice: Subject to any disclaimer, the term of this patent is extended or adjusted under 35 U.S.C. 154(b) by 17 days.

(21) Appl. No.: 15/267,672

(22) Filed: Sep. 16, 2016

(65) Prior Publication Data

US 2017/0081869 A1 Mar. 23, 2017

Related U.S. Application Data

(60) Provisional application No. 62/220,513, filed on Sep. 18, 2015.

(51) Int. Cl.
*E04H 4/08* (2006.01)

(52) U.S. Cl.
CPC ..... *E04H 4/088* (2013.01)

(58) Field of Classification Search
CPC E04H 4/082; E04H 4/08; E04H 4/084; E04H 4/086; E04H 4/088
See application file for complete search history.

(56) References Cited

U.S. PATENT DOCUMENTS

| | | | | |
|---|---|---|---|---|
| 2,895,143 | A * | 7/1959 | Seitz | E04H 4/088 4/500 |
| 4,374,537 | A | 2/1983 | Lindbergh | |
| 5,947,178 | A | 9/1999 | Patten | |
| 2009/0025135 | A1 | 1/2009 | Huber | |
| 2011/0048654 | A1 * | 3/2011 | Kolar | E04H 4/084 160/188 |

* cited by examiner

*Primary Examiner* — Janie Loeppke
(74) *Attorney, Agent, or Firm* — Thomas C. Saitta

(57) ABSTRACT

A spa cover and receptacle in combination, the spa cover being a retractable, folding, insulating spa cover with interconnected, plural, elongated, generally rectangular, panel members, the panel members being connected to each other along their longitudinal edges or sides by hinge members that act as seals to close the entire gap between adjoining panel members, wherein the hinge members alternate between the upper and lower surfaces of adjacent panel members, such that the panel members are easily foldable into a vertical stack. The open-topped receptacle is provided with roller members to reduce friction when the panel members are delivered into the panel members in a vertical stack adjacent the spa, the receptacle being a free-standing member, a member mounted to the spa wall, or a member manufactured as an integral component of the spa housing.

18 Claims, 3 Drawing Sheets

COMBINATION FOLDING SPA COVER AND RECEPTACLE

BACKGROUND OF THE INVENTION

This invention relates generally to the field of removable covers that prevent water and debris from entering spa tubs, hot tubs or the like, and which insulate to prevent heat loss when the tubs are not in use, and more particularly relate to such covers that are provided in multiple parts.

Spa tubs, hot tubs or the like, to be referred to herein collectively as spas, are popular in home, hotel and rehabilitation settings and are used for recreation, relaxation and therapy. The spas typically contain a quantity of heated water that is recycled through water jets, and may vary in shape from generally rectangular to generally round. The spas are usually sized to accommodate four to six people at one time, although smaller and larger spas are also available. Often the spas are located outdoors on patios or porches. Because the water is often maintained at an elevated temperature even when the spas are not in use, insulated covers are provided to limit heat loss and thereby reduce energy costs. The covers also prevent debris and rain water from entering the spa water, and provide a safety barrier.

Typical known insulated covers are structured in large panel form, such that usually one, two or three substantially rigid panels are placed across the open top of the spa, with each of the panel cover members when presented in multiples being separate and distinct members that are not connected to each other. The cover panels are usually several inches thick for insulation and structural purposes, and may comprise for example a main body of insulating material, such as polymer foam, encased within a waterproof outer layer of sheet material, such as HDPE or other plastic. Though not excessively heavy, they are of significant weight and the large size of the cover panels makes them unwieldy when handled, such that removal and replacement by children or older adults may be difficult. In addition, the large size of the panel members makes it difficult to store them unobtrusively when the spa is in use.

Another type of spa cover is composed of a plurality of relatively narrow, slat-like, rectangular panel members, such that removal and replacement of the individual members is easier. In some embodiments the slat-like panel members are connected to each other in an alternating hinged manner so as to prevent passage of debris and water between the panel members while allowing the cover to be folding upon itself in accordion-like manner, such that the individual panels comprising the cover can be stacked vertically beside the spa without interfering with the enjoyment of the spa. In known embodiments, the cover panels are provided with wheels positioned in opposing track or guide members mounted on the spa such that the individual panel members are received within the opposing track members in a manner that allows the panel members to be retracted and advanced along the track to uncover and cover the spa. This structure however, is mechanically complicated and the track members mounted onto the spa are unsightly and interfere with enjoyment of the spa by interfering with ingress and egress.

It is an object of this invention to provide an improved spa cover of the type consisting of multiple slat-like members joined in an alternating hinged manner such that the individual cover members may be stacked accordion-style in a vertical stack, the spa cover being combined with a receptacle member, free-standing or mounted to the spa, wherein the receptacle comprises a roller member such that lateral movement of the spa cover is easily accomplished, the folded members of the spa cover falling into the receptacle to form a vertical stack.

SUMMARY OF THE INVENTION

The invention is the combination of a spa cover and a receptacle for receiving and retaining the spa cover in a stacked manner when the spa is uncovered. The spa cover is a removable or retractable, folding, insulating member comprising plural, elongated, generally rectangular, slat-like, insulated panel members, the panel members being connected to each other along their longitudinal edges by hinge members for hingedly joining adjacent panel members. The hinge members preferably act as seals to cover the entire gap between adjoining panel members, such that water and debris cannot pass between the panel members and into the spa, and such that the thermal insulating properties of the cover are maximized. The hinge members are affixed in alternating manner along the upper and lower surfaces of the panel members, such that for a given panel member one hinge member will be at the upper surface on one longitudinal edge and joined to the upper surface of an adjacent panel member, and the other hinge member will be at the lower surface on the other longitudinal edge and joined to the lower surface of the other adjacent panel member. With this structure the panel members are foldable in an accordion-like manner into a vertical stack one atop the other when removed from the spa.

The receptacle is preferably a box-like or framed member that is either attached to the spa, built into the spa or provided as a free-standing member adjacent the spa. The receptacle is provided with at least one roller or wheel, and is preferably provided with a separated pair of wheels or rollers positioned in parallel on one side of the spa housing at or near the upper surface level of the spa. The receptacle is open at the top such that the panel members of the spa cover fall into and are retained by the receptacle in a vertically stacked manner as the cover is slid or pushed horizontally along and from the top of the spa. The spa cover passes over the roller members to reduce drag, thereby enabling the spa cover to be easily stored and then replaced. A leash, handle or similar extendible member may be provided on the uppermost panel member when the panel members are stacked within the receptacle to provide an easy means to withdraw the spa cover from the receptacle in order to recover the spa.

Alternatively described, the invention is a spa cover and a receptacle member in combination; said spa cover comprising a plurality of interior panel members and a pair of end panel members, each of said interior panel members and said end panel members comprising a pair of longitudinal sides, an upper surface and a lower surface; said interior panel members and said end panel members adapted to be disposed horizontally to cover a spa in a manner that precludes debris from entering the spa; each said interior panel member being joined to an adjacent said interior panel member or to an adjacent end panel member by hinge members, wherein for each said interior panel member said hinge members are mounted at or adjacent said upper surface for one of said longitudinal sides and are mounted at or adjacent said lower surface for the other of said longitudinal sides; wherein said hinge members are adapted to allow said interior panel members and said end panel members to be folded accordion-style into a vertical folded stack; said receptacle member adapted to receive said interior panel members and said end panel members oriented in a vertical stack, said receptacle comprising at least one roller member disposed adjacent one of said end panel members when said end panel members are disposed atop the spa; whereby when said spa cover is moved across the spa and across said at least one roller member, said interior panel members and said end panel members become positioned in said vertical folded stack within said receptacle member.

Alternatively described, the invention is a spa cover and a receptacle member in combination; said spa cover comprising panel members each comprising a pair of longitudinal sides, an upper surface and a lower surface, said panel members adapted to be disposed horizontally atop a spa in a manner that precludes debris from entering the spa; hinge members connecting said longitudinal sides of each adjacent said panel members, said hinge members alternating between said upper surfaces and said lower surfaces, wherein said hinge members are adapted to allow said panel members to be folded accordion-style into a vertical folded stack, wherein said hinge members extend the entire length of said longitudinal sides and preclude water from passing between adjacent panel members; said receptacle member adapted to receive panel members oriented in a vertical stack, said receptacle comprising at least one roller member disposed adjacent one of said panel members when said panel members are disposed atop the spa; wherein said receptacle member comprises a pair of vertical members, said at least one roller member being disposed atop said vertical members, horizontal members defining a lower shelf to support said vertical folded stack, and outrigger arms each comprising a lower retainer segment and an upper deflection segment; whereby when said spa cover is moved across the spa and across said at least one roller member, said panel members become positioned in said vertical folded stack within said receptacle member.

DETAILED DESCRIPTION OF THE INVENTION

Figure 1:
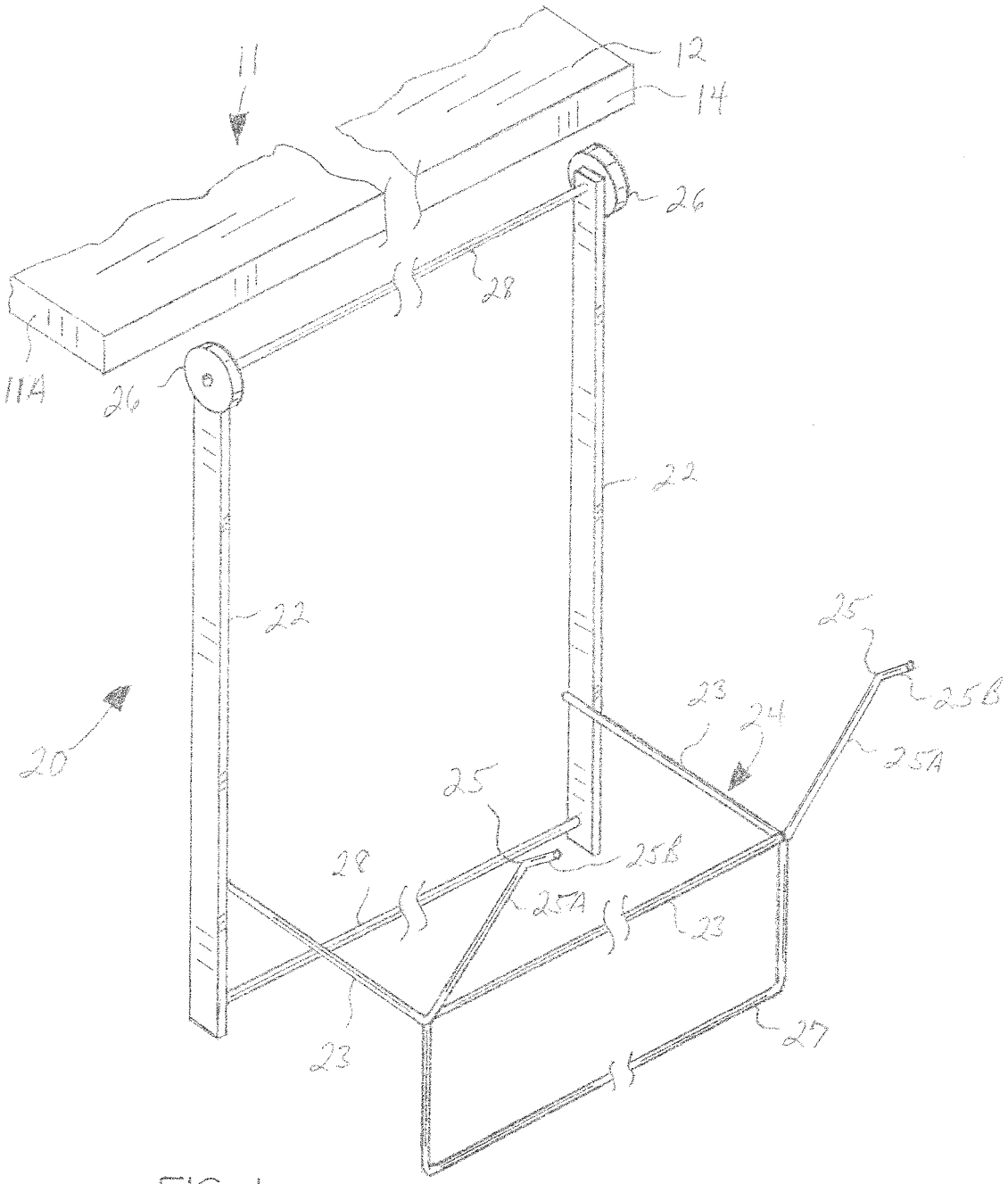
FIG. 1 is a truncated perspective view of a free-standing frame embodiment of the receptacle.

With reference to the drawings, the invention will now be described in detail with regard for the best mode and the preferred embodiment. In general, the invention is the combination of a spa cover 10 and a receptacle 20, the spa cover 10 being a removable, retractable, folding, insulating spa cover 10 presenting a horizontally extending coverage area, the spa cover 10 comprising a plural number of elongated, slat-like, interconnected, panel members 11 capable of being folded and positioned in a vertical stack of relatively small footprint when the cover 10 is removed and the spa 30 is in use. The receptacle 20 is a free-standing open-topped member positioned adjacent the spa 30, or may be a receptacle 20 that is affixed to the wall 31 of the spa 30 or manufactured as an integral component of the spa 30 itself.

The spa cover 10 comprises a plural number of insulating panel members 11, the majority of the panel members 11 being interior panel members 11B connected to adjacent other panels 11 and two of said panel members 11 being end panel members 11A each connected to a single interior panel 11B. The panel members 11 are elongated, narrow and generally rectangular in shape, such that the panel members 11 comprise a number of slat-like elements. When in use to cover the spa 30, the individual panel members 11 are aligned laterally in a generally co-planar horizontal orientation in a manner which covers the open top of the spa 30. Adjacent panel members 11 are connected in hinged manner along their longitudinal sides or edges 14 to form the spa cover 10. The panel members 11 are preferably composed of an insulating polymer foam material encased within a waterproof polymer sheet material, the sheet material forming an envelope to fully encase the foam, although it is contemplated to form the panel members 11 of other material having properties capable of performing the necessary functions. In known manner, bracing or support members may be utilized internally or externally to increase rigidity of the elongated panel members 11 when the stiffness of the insulating material is not sufficient to preclude excessive flexing when the panel members 11 are positioned atop and spanning the spa 30. Each panel member 11 possesses an upper surface 12 and a lower surface 13, upper surface 12 and lower surface 13 being defined herein as their relative orientations when the spa cover 10 is in place atop the spa 30.

Hinge members 15 structured and adapted to connect adjacent panel members 11 along the longitudinal sides 14 in an accordion-style manner are provided such that each of the panel members 11 is foldable onto an adjacent panel member 11 to form a vertical stack. Hinge members 15 may comprise for example elongated strips of flexible plastic sheeting extending the length of the panels 11, or the material covering multiple panel members 11 may be stitched or bonded together. For a particular interior panel member 11B, the hinge members 15 are positioned alternately relative to the upper surface 12 and lower surface 13 of each individual interior panel member 11B, i.e., the hinge member 15 on one longitudinal edge 14 being at or adjacent the upper surface 12 of the interior panel member 11B and the hinge member 15 on the opposite longitudinal edge 14 being at or adjacent the lower surface 13 of the interior panel member 11B. For the end panel members 11A, the hinge member 15 will be located on only one of the longitudinal sides 14. With this structure each interior individual panel member 11B is joined to a first adjacent panel member 11B or 11A at or adjacent the upper surface 12 of both adjacent panels 11 on a first side, and to a second adjacent panel member 11B or 11A at or adjacent the lower surface 13 of both adjacent panels 11 on the opposite second side. Thus the hinge members 15 will alternate upper-lower-upper-lower, etc., successively across the spa cover 10.

In this manner all of the interconnected panel members 11 can be folded into a single vertical stack of relatively small footprint when access to the spa 30 is desired. The panel members 11 are relatively narrow in width, such that the width of the vertical stack is minimized. Most preferably, the hinge members 15 are formed of a waterproof, flexible sheet material that acts as a gasket or seal, such that with the hinge members 15 extending the full length of the panel members 11, the gaps between the adjoining panel members 11 are sealed or covered by the hinge members 15 to preclude passage of water and debris into the spa, as well as to provide a more complete thermal barrier to heat loss. The dimensions of the panel members 11 are not critical, but for purposes of providing a non-limiting example, it has been found that suitable dimensions for each panel member 11 may be between about 1 to 3 inches in thickness and between about 6 to 18 inches in width, with the length and number of panel members 11 being determined by the dimensions of the spa 30 being covered.

An open-topped receptacle member 20 is provided adjacent one side of the spa 30, the receptacle member 20 having a frame-like structure, or alternatively a closed box-like structure, possibly with a removable lid. The dimensions of the receptacle 10 are such that the open internal area is sufficient to receive all of the spa cover panel members 11 in a vertical stack. In the embodiment shown in FIG. 1, the receptacle 20 is composed of a pair of vertical members 22, a lower shelf 24 formed by horizontal members 23, brace members 28, and leg members 27, the distance between the opposing horizontal members 23 being less than the length of the spa cover panel members 11 such that the panel members 11 will be retained by the lower shelf 24. Alternatively, the receptacle 20 could be open on the bottom such that the vertical stack of panel members 11 rests on the floor, deck, ground or other surface supporting the spa 30. Outrigger arms or extensions 25 are provided to guide the initial and following panel members 11 properly onto the lower shelf 24. Preferably, each outrigger arm 25 is comprised of a lower retainer segment 25A, which is vertically oriented or angled slightly outward, for example up to about 20 degrees from vertical, and an upper deflector segment 25B, which is angled farther outward than the retainer segments 25A for example up to about 40 degrees from vertical. The deflector segment 24B assists in directing the panel members 11, especially end panel member 11A, into the interior of the receptacle 20, and the retainer segment 25A assists in maintaining the folded panel members 11 in a vertical stack.

One or more roller members 26, being rollers, wheels or the like, are mounted to the tops of the vertical members 22 or otherwise across the upper portion of the receptacle 20, the overall length of a single roller member 26 or the distance between paired roller members 26 being less than the length of the spa cover panel members 11 such that the panel members 11 will be supported by the roller members 26 as the spa cover 10 is advanced off the spa 30 and into the receptacle 20 or retrieved from the receptacle 20 and pulled onto the spa 30. The vertical positioning of the roller members 26 is such that the one or more roller members 26 are located at or near the top of the spa 30.

Figure 4:
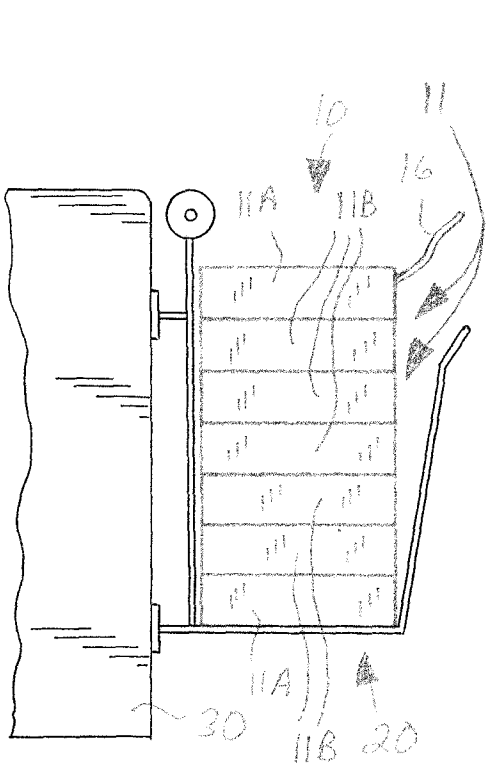
FIGS. 2 through 4 are successive side views showing the spa cover being removed from atop the spa and deposited into the receptacle, the receptacle of this embodiment being mounted to the spa housing.
Figure 3:
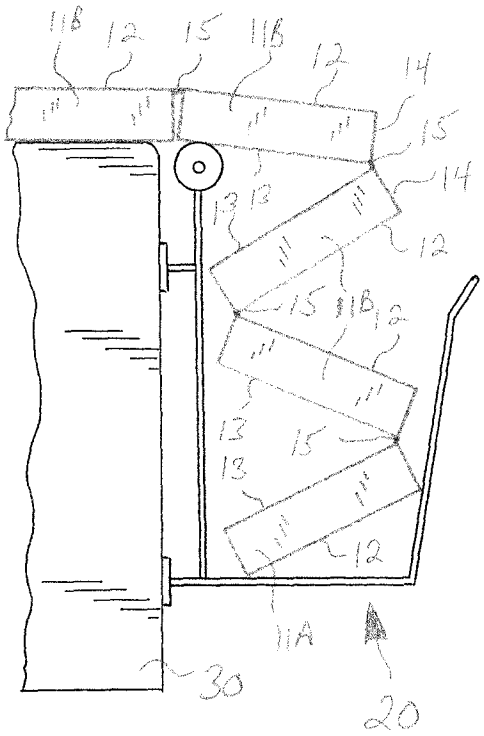
Figure 2:
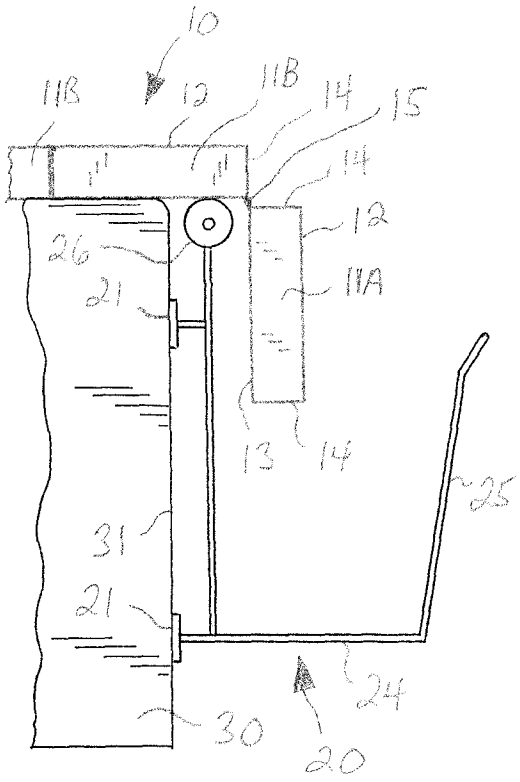
Figure 5:
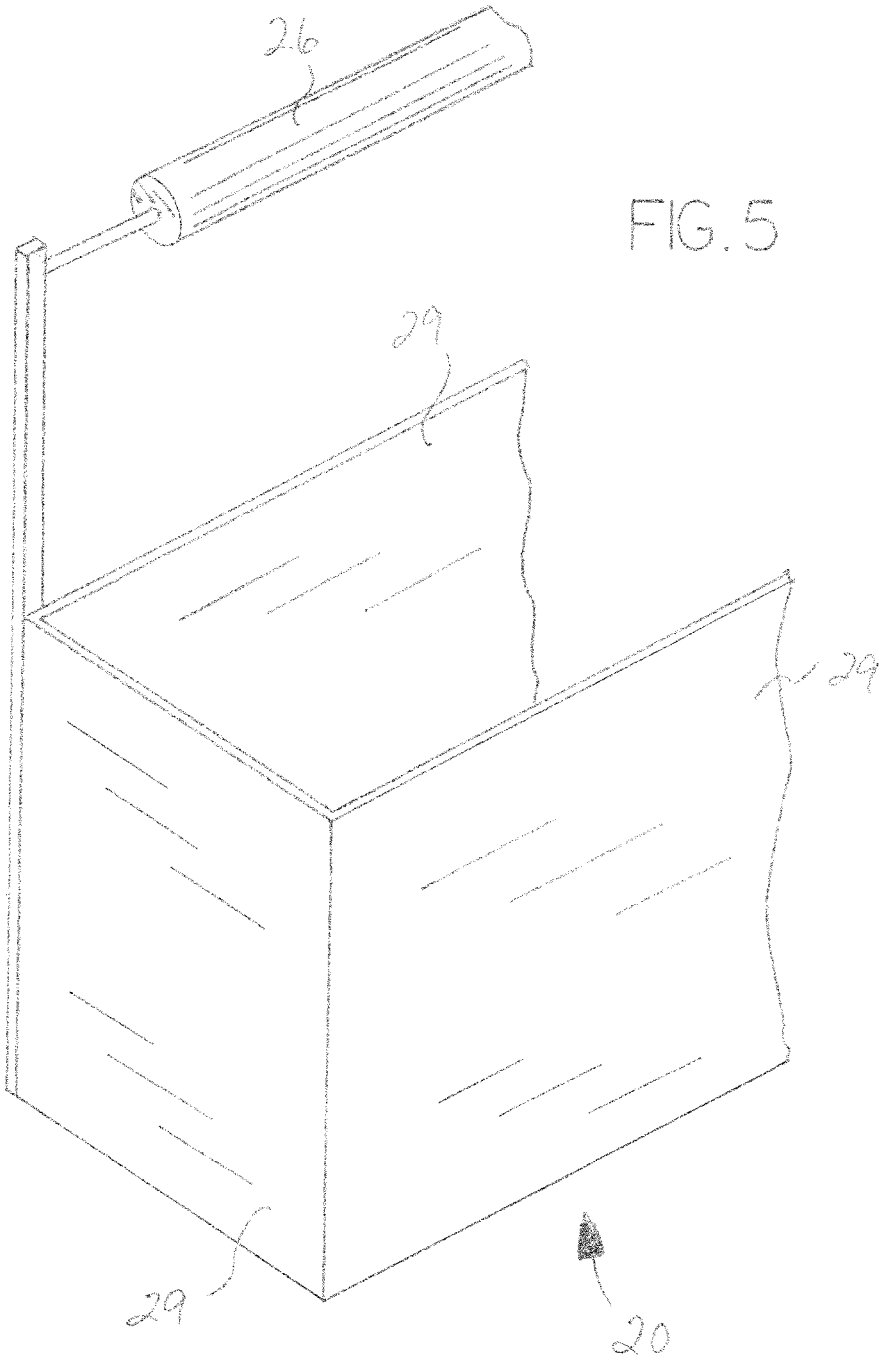
FIG. 5 is a partial view of another alternative embodiment for the receptacle.

FIG. 1 illustrates a free-standing receptacle 20 that is readily adaptable for use with existing spas, while FIGS. 2-4 illustrate a receptacle 20 affixed to or mounted onto the spa wall 31 using mounting members 21. FIG. 5 illustrates a box-like embodiment of a receptacle 20 formed with wall members 29. In an embodiment not illustrated, the receptacle 20 may be built into the spa wall 31 during manufacture.

The removal of the spa cover 10 and its placement into the receptacle 20 is shown successively in FIGS. 2-5. As the spa cover 10 is advanced toward the receptacle 20, the first or nearest end panel 11A passes over the roller members 26 and begins dropping into the interior of the receptacle 20 (FIG. 2), the initial panel 11A being joined to its adjacent or second panel 11 by a hinge member 15 along their lower surfaces 13, thereby allowing the initial panel 11A to angle downward under the effect of gravity. The second panel 11 is hingedly connected to the third panel 11 along their upper surfaces 12, such that the third panel 11 reverse folds onto the second panel 11 in the vertical stack. The outrigger arms 25 act to direct and restrain the panel members 11 during the folding operation so that a proper vertical stack is achieved within the receptacle 20. As the spa cover 10 is further advanced over the roller members 26 toward the receptacle 20, panels 11 stack upon themselves in this alternating manner due to the alternating pattern of the hinge members 15 from adjacent lower sides 13 to adjacent upper sides 12 on adjoining panels 11 (FIG. 3). This produces a compact vertical folded stack with a small footprint when the spa cover 10 is not in use (FIG. 5), with upper surfaces 12 abutting adjacent upper surfaces 12 and lower surfaces 13 abutting adjacent lower surfaces 13.

To re-cover the spa 30, the operation is reversed. The uppermost end panel 11A in the stack is pulled onto the roller members 26 and across the upper surface of the spa 30, with successive panels 11 following. A leash, handle or similar grasping member 16 may be attached to one or both end panels 11A for easier movement of the panels 11 across the spa 30.

It is understood that equivalents and substitutions for certain elements set forth above may be obvious to those of skill in the art, and therefore the true scope and definition of the invention is to be as set forth in the following claims.

I claim:

1. A spa cover and a receptacle member in combination;

said spa cover comprising a plurality of interior panel members and a pair of end panel members, each of said interior panel members and said end panel members comprising a pair of longitudinal sides, an upper surface and a lower surface;

said interior panel members and said end panel members adapted to be disposed horizontally to cover a spa in a manner that precludes debris from entering the spa;

each said interior panel member being joined to an adjacent said interior panel member or to an adjacent end panel member by hinge members, wherein for each said interior panel member said hinge members are mounted at or adjacent said upper surface for one of said longitudinal sides and are mounted at or adjacent said lower surface for the other of said longitudinal sides;

wherein said hinge members are adapted to allow said interior panel members and said end panel members to be folded accordion-style into a vertical folded stack;

said receptacle member adapted to receive said interior panel members and said end panel members oriented in a vertical stack, said receptacle comprising at least one roller member disposed adjacent one of said end panel members when said end panel members are disposed atop the spa;

wherein said receptacle member comprises a pair of vertical members, said at least one roller member being disposed atop said vertical members, horizontal members defining a lower shelf to support said vertical folded stack, and outrigger arms each comprising a lower retainer segment and an upper deflection segment;

whereby when said spa cover is moved across the spa and across said at least one roller member, said interior panel members and said end panel members become positioned in said vertical folded stack within said receptacle member.

2. The combination of claim 1, wherein when said interior panel members and said end panel members are positioned in said vertical folded stack, adjacent said upper surfaces abut each other and adjacent said lower surfaces abut each other.

3. The combination of claim 1, wherein said hinge members alternate between an upper position and a lower position relative to said interior panel members.

4. The combination of claim 1, wherein said hinge members extend the entire length of said longitudinal sides.

5. The combination of claim 1, wherein said hinge members preclude water from passing between adjacent said interior panel members and said end panel members.

6. The combination of claim 1, wherein said at least one roller member comprises a roller.

7. The combination of claim 1, wherein said at least one roller member comprises a pair of wheels.

8. The combination of claim 1, wherein said receptacle member comprises outrigger arms, said outrigger arms each comprising a lower retainer segment and an upper deflection segment.

9. The combination of claim 8, wherein said lower retainer segments are oriented from vertical up to about 20 degrees from vertical, and wherein said deflector segments are oriented farther from vertical than said lower retainer segments and up to about 40 degrees from vertical.

10. The combination of claim 1, wherein said lower retainer segments are oriented from vertical up to about 20 degrees from vertical, and wherein said deflector segments are oriented farther from vertical than said lower retainer segments and up to about 40 degrees from vertical.

11. The combination of claim 1, wherein said receptacle member comprises wall members.

12. The combination of claim 1, further comprising mounting members adapted to affix said receptacle member to the spa.

13. The combination of claim 1, further comprising a gripping grasping member affixed to at least one of said end panel members.

14. A spa cover and a receptacle member in combination;

said spa cover comprising panel members each comprising a pair of longitudinal sides, an upper surface and a lower surface, said panel members adapted to be disposed horizontally atop a spa in a manner that precludes debris from entering the spa;

hinge members connecting said longitudinal sides of each adjacent said panel members, said hinge members alternating between said upper surfaces and said lower surfaces, wherein said hinge members are adapted to allow said panel members to be folded accordion-style into a vertical folded stack;

said receptacle member adapted to receive panel members oriented in a vertical stack, said receptacle comprising at least one roller member disposed adjacent one of said panel members when said panel members are disposed atop the spa;

wherein said receptacle member comprises a pair of vertical members, said at least one roller member being disposed atop said vertical members, horizontal members defining a lower shelf to support said vertical folded stack, and outrigger arms each comprising a lower retainer segment and an upper deflection segment;

whereby when said spa cover is moved across the spa and across said at least one roller member, said panel members become positioned in said vertical folded stack within said receptacle member.

15. The combination of claim 14, wherein said hinge members extend the entire length of said longitudinal sides and preclude water from passing between adjacent panel members.

16. The combination of claim 14, wherein said receptacle member comprises outrigger arms, said outrigger arms each comprising a lower retainer segment and an upper deflection segment.

17. The combination of claim 16, wherein said lower retainer segments are oriented from vertical up to about 20 degrees from vertical, and wherein said deflector segments are oriented farther from vertical than said lower retainer segments and up to about 40 degrees from vertical.

18. A spa cover and a receptacle member in combination;

said spa cover comprising panel members each comprising a pair of longitudinal sides, an upper surface and a lower surface, said panel members adapted to be disposed horizontally atop a spa in a manner that precludes debris from entering the spa;

hinge members connecting said longitudinal sides of each adjacent said panel members, said hinge members alternating between said upper surfaces and said lower surfaces, wherein said hinge members are adapted to allow said panel members to be folded accordion-style into a vertical folded stack, wherein said hinge members extend the entire length of said longitudinal sides and preclude water from passing between adjacent panel members;

said receptacle member adapted to receive panel members oriented in a vertical stack, said receptacle comprising at least one roller member disposed adjacent one of said panel members when said panel members are disposed atop the spa; wherein said receptacle member comprises a pair of vertical members, said at least one roller member being disposed atop said vertical members, horizontal members defining a lower shelf to support said vertical folded stack, and outrigger arms each comprising a lower retainer segment and an upper deflection segment;

whereby when said spa cover is moved across the spa and across said at least one roller member, said panel members become positioned in said vertical folded stack within said receptacle member.

* * * * *